United States Patent [19]

Rising

[11] Patent Number: 4,961,230

[45] Date of Patent: Oct. 2, 1990

[54] HEARING AID PROGRAMMING INTERFACE

[75] Inventor: Rolf C. Rising, Kungbacka, Sweden

[73] Assignee: Diaphon Development AB, Molndal, Sweden

[21] Appl. No.: 192,242

[22] Filed: May 10, 1988

[51] Int. Cl.[5] ..... H04R 25/02

[52] U.S. Cl. ..... 381/69.2; 381/68; 381/69

[58] Field of Search ..... 381/69.2, 69.1, 69, 381/68, 60; 73/585

[56] References Cited

U.S. PATENT DOCUMENTS

| | | | |
|---|---|---|---|
| 4,075,561 | 2/1978 | Stevens | 324/149 |
| 4,425,481 | 1/1984 | Mansgold et al. | 381/68.2 |
| 4,471,171 | 9/1984 | Köpke et al. | 381/60 |
| 4,548,082 | 10/1985 | Engebretson et al. | 73/585 |

FOREIGN PATENT DOCUMENTS 3624619 1/1988 Fed. Rep. of Germany .

*Primary Examiner*—Jin F. Ng
*Assistant Examiner*—M. Nelson McGeary, III.
*Attorney, Agent, or Firm*—Flehr, Hohbach, Test, Albritton & Herbert

[57] ABSTRACT

A programmable hearing aid having a battery compartment which holds a battery under normal operating conditions is also adapted to hold a coupler member for connecting an external programming device to the hearing aid. To connect an external programming device to the hearing aid, lead wires in contact with the programming device are contacted with battery and programming terminals in the battery compartment by means of a coupling member. The coupling member is shaped to fit in the battery compartment and has electrodes in contact with the lead wires from the programming device arranged for contacting the battery and programming terminals in the battery compartment.

10 Claims, 5 Drawing Sheets

HEARING AID PROGRAMMING INTERFACE

The present invention relates generally to hearing aid devices, and more particularly to an arrangement for facilitating the direct connection of an external programming system to the circuitry inside a hearing aid.

BACKGROUND OF THE INVENTION

Programmable hearing aids, such as the hearing aid disclosed in U.S. Pat. No. 4,425,481 (Mangold et al., 1984) can store a number of distinct programs, or sets of parameter values, each designed for use in different audio environments. For instance, a hearing aid with eight distinct programs could have programs for a variety of correspondingly distinct situations, such as conversing with one person in a quiet room, conversing with several persons in an otherwise fairly quiet environment, conversing with one or more persons in settings with increasing levels of background noise, walking or commuting environments with large noise variations, listening to music in a quiet room, and listening to music in a noisy environment.

In addition, the various programs in a programmable hearing aid must be customized to compensate for an individual's particular hearing deficiencies. However, some aspects of hearing aid programming are inherently subjective on the part of the user—and therefore hearing aids often must be reprogrammed several times before an optimal set of programs is found. In addition, a person's hearing characteristics may change over time, requiring adjustment of the programs stored in a programmable hearing aid. As a result, programmable hearing aids should be easily reprogrammed.

One problem associated with the design of programmable hearing aids is balancing the competing objectives of miniaturization and providing a convenient interface for connecting the device to an external programming system for reprogramming the device. In particular, a major objective in the design of hearing aids is designing very small devices, and the size of new hearing aid models is decreasing with the development of miniaturized circuitry.

In order to make a device small, it is necessary to eliminate as many components of the device as possible. In the context of the present invention, it would be desirable to eliminate the need for an external input/output port for connecting an external programming system to the hearing aid. That is, due to the limited size and surface area of miniaturized hearing aids, it is undesirable to use a portion of the device's interior volume and exterior surface area as a programming port.

In some systems proposed by hearing aid developers, a programmable hearing aid device could be programmed by remote control. In other words, a hearing aid could be programmed by wireless transmission of hearing aid parameters using either ultrasonic or radio frequency transmission techniques. However, ultrasonic and radio frequency transmission methods suffer from at least one major problem: the need for added circuitry to detect and decode the programming signals. While this problem is not insurmountable, it does increase the amount of circuitry needed in the hearing aid, and generally increases the cost of the hearing aid and the associated programming circuitry.

The present invention has the advantage of providing a direct electrical connection for programming a hearing aid, and yet it avoids the need for an external port devoted solely to the programming function. In addition, no added circuitry is needed to detect and decode programming signals.

SUMMARY OF THE INVENTION

In summary, the present invention is a programmable hearing aid having a battery compartment which normally holds a battery cell. A pair of battery terminals in the battery compartment electrically couples a battery positioned in the compartment to the hearing aid's functional circuitry. A programming terminal located in the battery compartment is situated so that it contacts a battery or other object situated in the battery compartment. The programming terminal is also electrically coupled to the hearing aid's internal programming circuitry. To connect an external programming device to the hearing aid, a set of three electrical wires connected to the programming device are brought into contact with the battery and programming terminals in the battery compartment via a coupling member shaped to fit in the battery compartment and having electrodes arranged for contacting the battery and programming terminals in the battery compartment when the coupling member is retained within the battery compartment.

BRIEF DESCRIPTION OF THE DRAWINGS

Additional objects and features of the invention will be more readily apparent from the following detailed description and appended claims when taken in conjunction with the drawings, in which:

DESCRIPTION OF PREFERRED EMBODIMENTS

Figure 1:
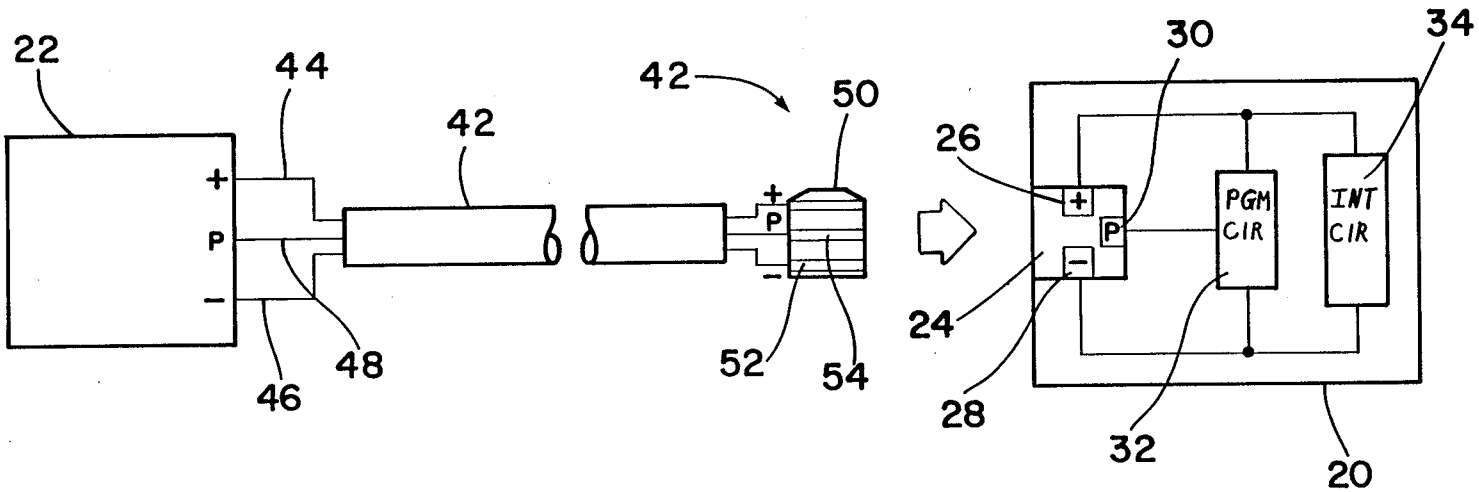
FIG. 1 is a block diagram showing how a hearing aid is coupled to an external hearing aid programming system.

Referring to FIG. 1 the present invention concerns a system for coupling a hearing aid 20 to an external hearing aid programming system 22. Since the hearing aid 20 is normally battery powered, hearing aid device 20 has a battery compartment 24 for holding a standard hearing aid battery. As is standard, two battery terminals 26 and 28 are located in the battery compartment 24 for contacting the positive (+) and negative (−) terminals of a battery.

Unlike standard hearing aid devices, in the present invention there is also a programming terminal 30 in battery compartment 24 that is coupled to programming circuitry 32 inside the hearing aid. During normal operation of the hearing aid, a battery is placed inside the battery compartment, supplying power to the hearing aid's internal circuitry 34. Programming terminal 30 is preferably located so that during normal hearing aid operation when a battery is in place in the battery compartment, the programming terminal contacts the positive voltage battery terminal. This arrangement obviates the need for connecting the programming terminal to the positive voltage battery terminal through a resistor, and thus avoids dissipation of power during normal operation.

For programming the hearing aid with information from external hearing aid programming system 22, the standard battery is removed from battery compartment 24 and is replaced by a coupling member 40 which is electrically coupled to programming system 22. According to preferred embodiments, a coaxial connector 42 carrying three leads 44, 46, and 48 (also denoted +, − and P, respectively) connects the external programming system 22 to hearing aid 20 via coupling member 40. Two of the leads 44 and 46 provide a voltage potential for providing power to hearing aid 20, equivalent to the voltage potential normally provided by a battery. The third lead 48 carries programming signals and reply signals which convey information from the external programming system 22 to the hearing aid 20 and also from the hearing aid 20 to the programming system 22.

Figure 2:
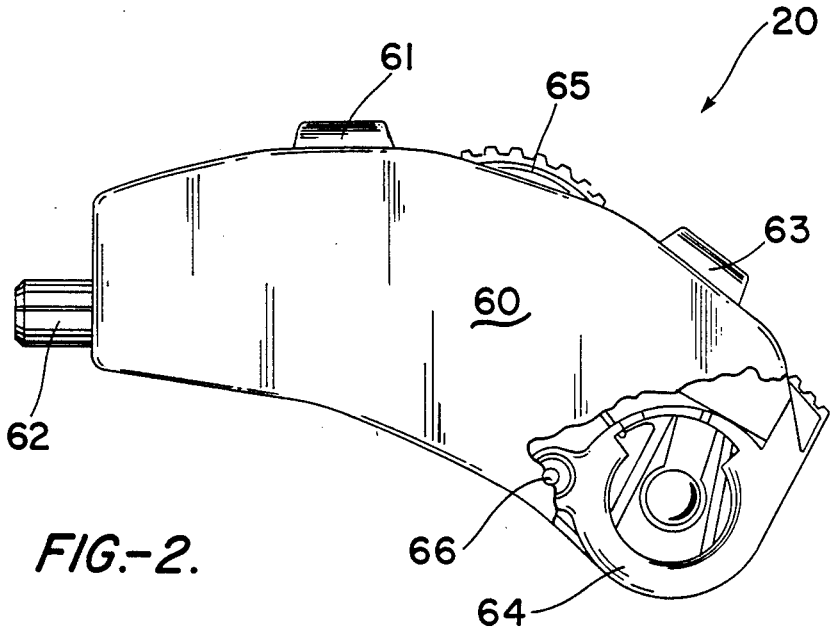
FIG. 2 is a plan view of a "behind-the-ear" hearing aid, with a cutaway view of the battery compartment and the hinged battery compartment door.

FIG. 2 illustrates a programmable hearing aid according to the present invention, the main body of which is designed to fit behind a person's ear. Hearing aid housing 60 encloses the internal and programming circuitry for the hearing aid and is connected via tubing 62 to an earpiece (not shown) which is inserted in the wearer's ear. Appropriate external control means generally designated 61 and 63, and adjustable external control means 65 are provided in contact with internal hearing aid circuitry for adjustment of various hearing aid parameters, as is known in the art.

Figure 3:
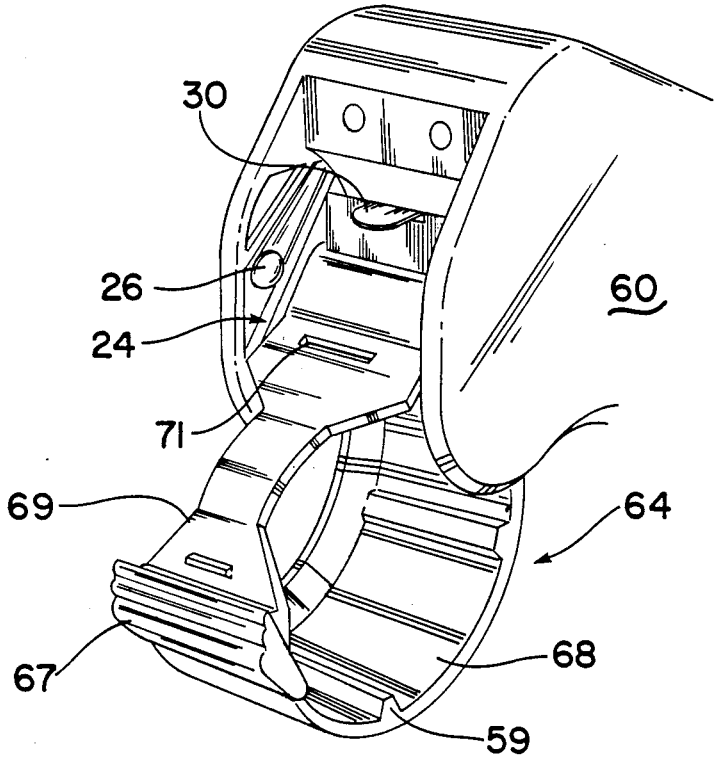
FIG. 3 is a perspective view of the battery compartment and the hinged battery compartment door of the programmable hearing aid.

As shown in FIGS. 2 and 3, battery compartment 24 is preferably located between two side walls of housing 60 at the end of the housing opposite the attachment of tubing 62. Battery compartment door 64 is hinged along pivot axis 66 for adjustment between a closed position within the battery compartment, as shown in FIG. 2, and an open, access position as shown in FIG. 3. Battery compartment 24 and battery compartment door 64 are preferably generally cylindrical. The battery compartment door preferably comprises arcuate outer wall 68 and arcuate inner wall 69 which form, in combination, a generally cylindrical battery recess. Outer wall 68 of the battery compartment door preferably includes shoulder 73 projecting interiorly therefrom which serves as a stop to retain the battery or programming coupler in the battery compartment door. Ribs 59, or the like, may be provided on an inner surface of the battery compartment door for securely retaining the battery or the coupling member. Access to battery compartment 24 may be obtained by exerting pressure at raised surface 67 to rotate battery compartment door 64 about its pivot axis 66.

Battery terminals 26 and 28 are preferably located generally opposite one another and adjacent interior surfaces of housing 60 in battery compartment 24. The battery terminals are positioned to contact the corresponding battery electrodes when a battery is loaded into the battery compartment and the battery compartment door is closed. Suitable types of battery terminals are well known in the art.

FIG. 3 illustrates a preferred embodiment of programming terminal 30 projecting into the battery compartment. Programming terminal 30 is electrically connected to the programming circuitry in hearing aid 20, and it is positioned in the battery compartment to contact the programming electrode on programming coupling member 40 when the coupling member is inserted in the battery compartment and the battery compartment door is closed. As shown in FIG. 3, slot 71 is provided in inner wall 69 of the battery compartment door for passage of the programming electrode when the battery compartment door is in the closed position. As the battery compartment door is closed by rotation about pivot axis 66, programming terminal 30 projects through slot 71 and is positioned to contact the battery or the coupling member.

Figure 4:
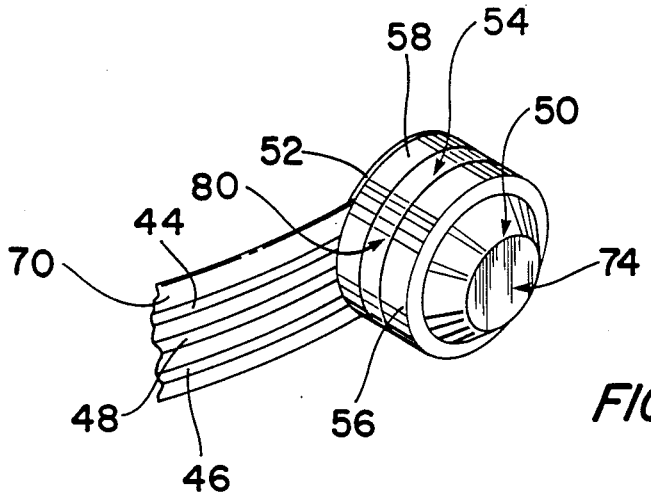
FIG. 4 is a perspective view of a coupling member shaped for fitting into the battery compartment and for contacting the battery and programming terminals in the battery compartment.
Figure 5:
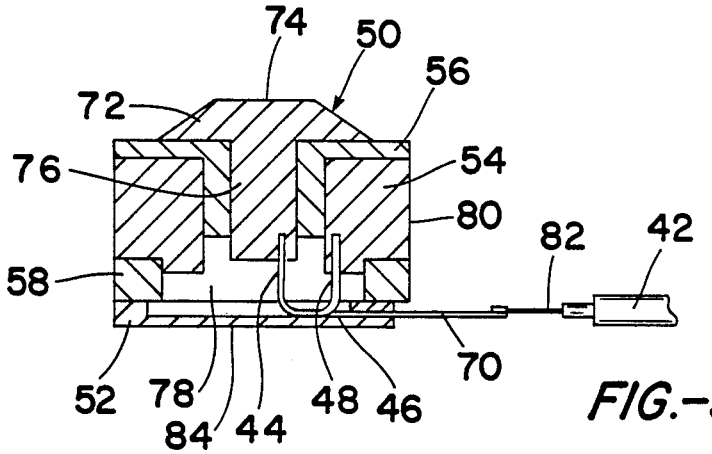
FIG. 5 shows a cross-sectional view of the coupling member shown in FIG. 4 and electrical connection means for electrically connecting the coupling member with the external cable.
Figure 6:
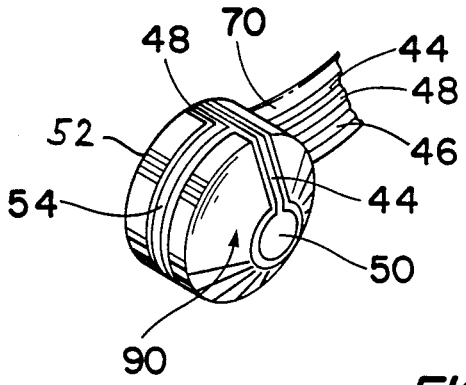
FIG. 6 shows a perspective view of an alternative embodiment of a coupling member shaped for fitting into the battery compartment and for contacting the battery and programming terminals in the battery compartment.

FIGS. 4–6 illustrate preferred embodiments of a generally disc-shaped coupling member 40 operatively engaged with coaxial connector 42. Coupling member 40 is sized to correspond generally to the configuration and dimensions of battery compartment 24. Electrodes 50 and 52 are provided on an outer surface of coupling member 40 for contacting battery terminals 26 and 28 provided in the battery compartment. Likewise, programming electrode 54 is provided on an outer surface of coupling member 40 for contacting programming terminal 30 in the battery compartment.

According to the embodiment of coupling member 40 shown in FIGS. 4 and 5, positive electrode 50 preferably comprises an outer portion 72 including generally flat contact surface 74, and a mounting pin 76 projecting generally centrally from the outer portion. Programming electrode 54 has a generally annular structure, including an outer contact surface 80. Positive electrode 50 and programming electrode 54 are electrically insulated from one another by means of non-conductive insulating element 56 interposed between the positive and programming electrodes. Negative electrode 52 includes a generally flat contact surface 84, and it is electrically insulated from programming electrode 54 by means of annular, non-conductive insulating element 58. The electrodes and insulating elements are preferably bonded to one another by suitable adhesives, and internal cavity 78 is preferably filled with an inert, non-conductive material such as a silicone adhesive.

Figure 7:
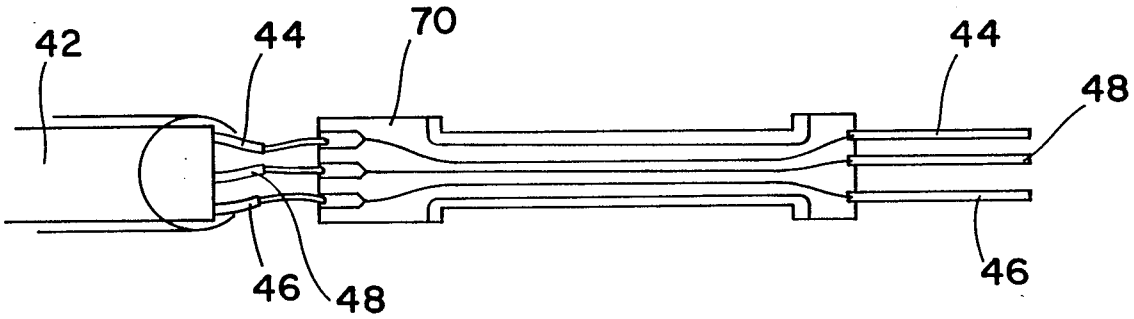
FIG. 7 shows an electrical connection means for establishing electrical contact between an external cable and the coupling member shown in FIGS. 4 and 5.

Positive electrode 50, negative electrode 52, and programming electrode 54 are in electrical contact with the corresponding leads 44, 46 and 48, respectively, from coaxial cable 42. As shown in FIG. 7, leads 44, 46 and 48 emerge from shielded coaxial cable 42 and are embedded in a substantially flat, non-conductive strip 70. Non-conductive strip 70 preferably comprises a thin, flexible, non-conductive film layer or the like. Suitable flexible, non-conductive materials are well known in the art. A non-conductive casing 82 may additionally be provided between cable 42 and strip 70 to insulate the electrical leads. Leads 44, 46 and 48 emerge from the non-conductive strip at the end opposite cable 42 for connection to the appropriate electrodes on coupling member 40.

Non-conductive strip 70 carrying leads 44, 46 and 48 is mounted between insulating element 58 and negative electrode 52 in the embodiment of coupling member 40 illustrated in FIGS. 4 and 5. As shown in FIG. 5, electrical leads 44, 46 and 48 project from the non-conductive strip 70 inside coupling member 40, and are electrically contacted to the corresponding electrodes in coupling member 40, as shown. Positive lead 44 is electrically connected to positive electrode 50; negative lead 46 is electrically connected to negative electrode 52; and programming lead 48 is electrically connected to programming electrode 54. Non-conductive strip 70 facilitates electrical connection of lead wires from the coaxial cable to the appropriate electrodes in the coupling member.

Figure 8:
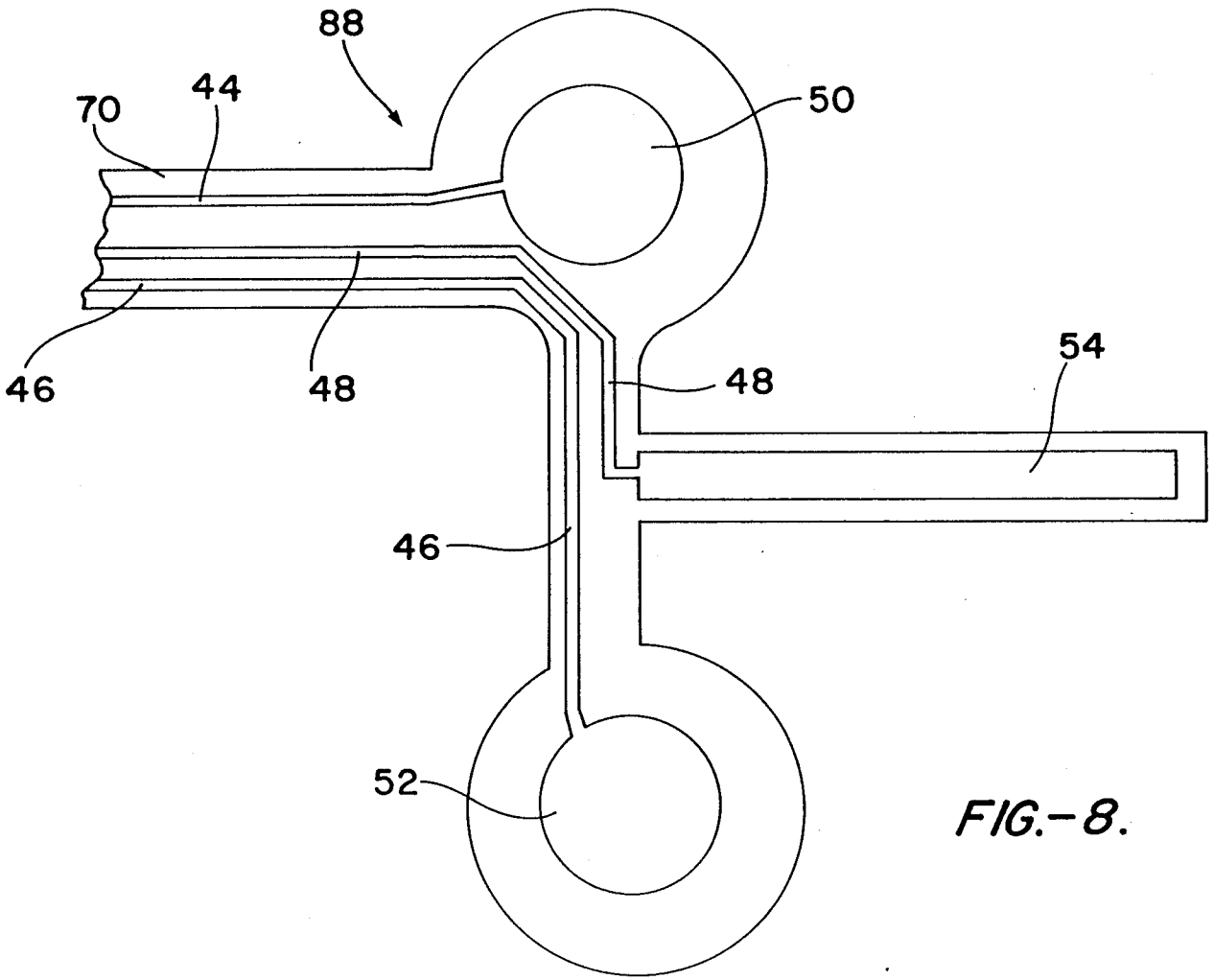
FIG. 8 shows a contact arrangement for establishing electrical contact between an external cable and the coupling member illustrated in FIG. 6.

FIG. 6 illustrates an alternative embodiment of coupling member 40 wherein the battery and programming electrodes are provided on the surface of an insulating member 90, and FIG. 8 illustrates a contact arrangement for use with insulating member 90. Insulating member 90 preferably comprises a single piece of non-conductive insulating material having dimensions corresponding generally to the dimensions of battery compartment 24. Contact arrangement 88 is an extension of non-conductive strip 70 having the battery and programming lead wires embedded therein. As shown in FIG. 8, lead wires 44, 46 and 48 are carried in a flexible, non-conductive layer, and each lead wire terminates in an electrode. Positive lead wire 44 is embedded in the flexible, non-conductive layer, and it terminates in a generally flat, circular positive electrode 50 which is carried on the surface of the non-conductive layer. Negative lead wire 46 likewise terminates in a generally flat, circular negative electrode 52 carried on the surface of the non-conductive layer. Programming lead wire 48 preferably terminates in programming electrode strip 54 carried on the surface of the non-conductive layer.

Contact arrangement 88 is affixed to the exterior surface of insulating member 90, with a suitable adhesive, to position the positive, negative and programming electrodes at locations to contact the corresponding battery and programming terminals in the battery compartment. Thus, as shown in FIG. 6, positive electrode 50 is affixed to a positive contact surface, while programming electrode 54 is affixed to the circumferential surface of insulating member 90. Negative electrode 52 is preferably affixed to the generally flat lower surface of insulating member 90. The embodiment of coupling member 40 illustrated in FIG. 6 thus has a simplified construction wherein the lead wires are in direct electrical contact with the corresponding electrodes, and the flexible film carrying the lead wires and the electrodes is bonded to the outer surface of the insulating member.

Although the programmable hearing aid device of the present invention is illustrated as a "behind-the-ear" type of hearing aid device, the present invention is equally applicable to "in-the-ear" hearing aid devices, in which the hearing aid components and housing are retained in the wearer's ear. Similarly, although the present invention has been described with reference to a single programming terminal and a single programming electrode, multiple programming terminals and corresponding programming electrodes may be provided in accordance with the present invention. Moreover, programming terminals having a variety of configurations may be used according to the present invention.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A programmable hearing aid energizable by electrical connection to a battery comprising:

a battery compartment having two battery terminals for contacting the positive and negative terminals of the battery, said battery terminals electrically coupled to circuitry in the programmable hearing aid; and a programming terminal coupled to programming circuitry in the programmable hearing aid device, said programming terminal being located in said battery compartment;

said battery compartment and programming terminal being physically arranged such that said programmable terminal is utilizable only when said battery is removed from said battery compartment.

2. A programmable hearing aid according to claim 1, additionally comprising a battery compartment door pivotably mounted for adjustment between a closed position within said battery compartment and an open, access position.

3. A programmable hearing aid system, comprising:

a programmable hearing aid energizable by electrical connection to a battery, said programmable hearing aid including a battery compartment having two battery terminals for contacting the positive and negative terminals of the battery, said battery terminals electrically coupled to circuitry in the programmable hearing aid; and a programming terminal coupled to programming circuitry in the programmable hearing aid device, said programming terminal being located in said battery compartment; said battery compartment and programming terminal being physically arranged such that said programmable terminal is utilizable only when said battery is removed from said battery compartment; and a coupling member sized to fit in said battery compartment, said coupling member having a programming electrode in electrical contact with an external hearing aid programming system and a positive electrode and a negative electrode in electrical contact with said external hearing aid programming system; said coupling member being adapted so that said programming electrode electrically contacts said programming terminal in said battery compartment and said positive and negative electrodes electrically contact said battery terminals in said battery compartment when said coupling member is inserted in said battery compartment.

4. The programmable hearing aid system of claim 3, wherein said programming electrode and said positive and negative electrodes are located on an exterior surface of said coupling member.

5. The programmable hearing aid system of claim 3, wherein said coupling member is generally disk-shaped, said positive and negative electrodes are positioned on opposite surfaces of said coupling member, and said programming electrode is positioned intermediate said positive and negative electrodes on a circumferential surface of said coupling member.

6. In combination, a programmable hearing aid, energizable by electrical connection to a battery, said programmable hearing aid including a battery compartment having two battery terminals for contacting the positive and negative terminals of the battery, said battery terminals electrically coupled to circuitry in the programmable hearing aid; and a programming terminal coupled to programming circuitry in the programmable hearing aid device, said programming terminal being located in said battery compartment; and a coupling member having a positive electrode, a negative electrode, and a programming electrode in electrical contact with an external hearing aid programming system, said coupling member mounted in said battery compartment with said positive and negative electrodes in electrical contact with said battery terminals and said programming electrode in electrical contact with said programming terminal;

said coupling member and said battery not being placeable within said battery compartment at the same time.

7. A coupling member for establishing electrical contact between a programmable hearing aid and an external hearing aid programming system, said programmable hearing aid being energizable by electrical connection to a battery; said coupling member sized to fit in a battery compartment in the programmable hearing aid and having a programming electrode and positive and negative electrodes in electrical contact with the external hearing aid programming system; wherein said battery must be removed before said coupling member is used to establish contact between said programmable aid and the external hearing aid programming system.

8. A coupling member according to claim 7, wherein said coupling member is generally disk-shaped, said positive and negative electrodes are positioned on an exterior surface of said coupling member generally opposite one another on said coupling member, and said programming electrode is positioned intermediate said positive and negative electrodes on a circumferential surface of said coupling member.

9. A method for programming a programmable hearing aid energized by a battery retained in a battery compartment in the hearing aid by electrical contact with an external hearing aid programming system, the method comprising:

locating a programming terminal in electrical contact with programming circuitry in the hearing aid in the battery compartment;

removing the battery retained in the battery compartment;

then inserting a coupling member having a programming electrode mounted thereon in said battery compartment, and electrically coupling said programming electrode with the external hearing aid programming system and with said programming terminal in the battery compartment.

10. A method for programming a programmable hearing aid according to claim 9, wherein said battery compartment has battery terminals therein and said coupling member has positive and negative electrode mounted thereon, additionally comprising the step of contacting said positive and negative electrodes to said battery terminals in said battery compartment.

* * * * *

US004961230B1

REEXAMINATION CERTIFICATE (3402nd)

United States Patent [19] [11] B1 4,961,230

Rising [45] Certificate Issued Dec. 23, 1997

[54] HEARING AID PROGRAMMING INTERFACE

[75] Inventor: Rolf C. Rising, Kungbacka, Sweden

[73] Assignee: Minnesota Mining and Manufacturing Company, St. Paul, Minn.

Reexamination Request:
No. 90/004,169, Feb. 14, 1996

Reexamination Certificate for:

| | |
|---|---|
| Patent No.: | **4,961,230** |
| Issued: | **Oct. 2, 1990** |
| Appl. No.: | **192,242** |
| Filed: | **May 10, 1988** |

[51] Int. Cl.[6] ..... H04R 25/02
[52] U.S. Cl. ..... 381/69.2; 381/68; 381/69
[58] Field of Search ..... 381/68, 68.6, 69, 381/69.2

[56] References Cited

U.S. PATENT DOCUMENTS 4,425,481 1/1984 Mangold et al. .
4,548,082 10/1985 Engebretson et al. .

FOREIGN PATENT DOCUMENTS

669296A5 2/1989 Switzerland .

OTHER PUBLICATIONS

"Weltneuheit: PHOX von Bernafon. Computer–programmierbare Horgerate"—published Dec. 1987 (German language Bernafon brochure with partial translation attached).

*Primary Examiner*—Forester W. Isen

[57] ABSTRACT

A programmable hearing aid having a battery compartment which holds a battery under normal operating conditions is also adapted to hold a coupler member for connecting an external programming device to the hearing aid. To connect an external programming device to the hearing aid, lead wires in contact with the programming device are contacted with battery and programming terminals in the battery compartment by means of a coupling member. The coupling member is shaped to fit in the battery compartment and has electrodes in contact with the lead wires from the programming device arranged for contacting the battery and programming terminals in the battery compartment.

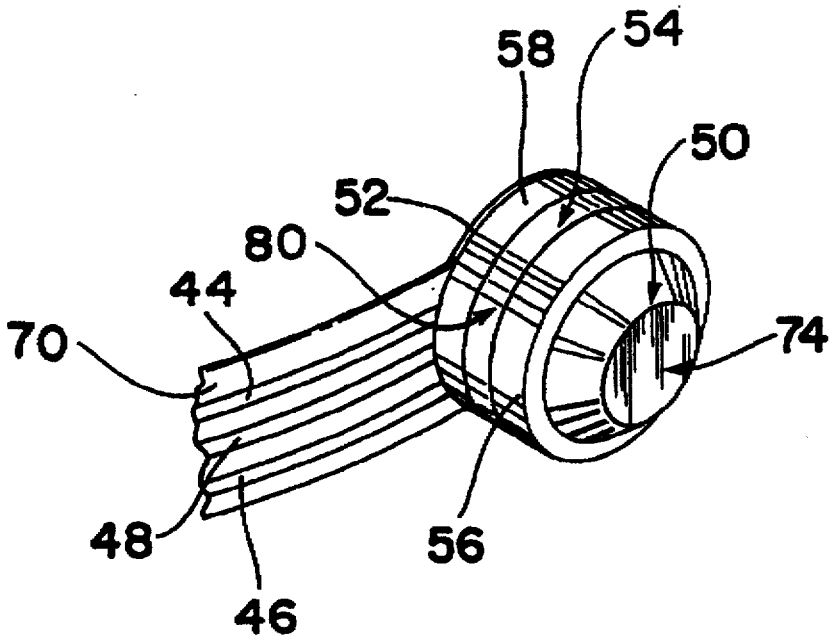

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 5 and 8 is confirmed.

Claims 1–4, 6, 7, 9 and 10 are cancelled.

* * * * *